United States Patent [19]

Wentworth et al.

[11] Patent Number: 5,025,868

[45] Date of Patent: Jun. 25, 1991

[54] PNEUMATIC GROUND PIERCING TOOL

[75] Inventors: Steven W. Wentworth, Greenfield; Robert F. Crane, Mequon; Jon A. Haas, Oconomowoc, all of Wis.

[73] Assignee: Earth Tool Corporation, Oconomowoc, Wis.

[21] Appl. No.: 435,953

[22] Filed: Nov. 13, 1989

[51] Int. Cl.[5] ..... B25D 9/00

[52] U.S. Cl. ..... 173/91; 173/137; 175/19

[58] Field of Search ..... 173/91, 134, 139, 17, 173/137; 175/19

[56] References Cited

U.S. PATENT DOCUMENTS 3,410,354 11/1968 Sudnishnikov et al. .
3,756,328 11/1968 Sudnishnikov et al. .
4,078,619 3/1978 Sudnishnikov et al. .
4,221,157 9/1980 Schmidt ..... 173/91
4,609,052 9/1986 Lewin ..... 173/91
4,662,457 5/1987 Bouplon .

*Primary Examiner*—Timothy V. Eley
*Assistant Examiner*—Willmon Fridie, Jr.
*Attorney, Agent, or Firm*—Foley & Lardner

[57] ABSTRACT

The present invention provides a self-propelled impact boring tool which, according to one aspect of the invention, has a simplified tail assembly so that the tool can be readily assembled and dissambled to allow replacement of worn parts. Such a tail assembly includes a nut and an end cap which can be secured together by a series of conventional bolts which extend into threaded holes in the nut. The nut, which is screwed into the rear end of the tool body, can be clamped in position with the screws with far less torque than would otherwise be required with a conventional, unitary tailpiece.

23 Claims, 3 Drawing Sheets

PNEUMATIC GROUND PIERCING TOOL

TECHNICAL FIELD

This invention relates to a pneumatic impact tools, particularly to self-propelled ground piercing tools.

BACKGROUND OF THE INVENTION

Self-propelled pneumatic tools for making small diameter holes through soil are well known. Such tools are used to form holes for pipes or cables beneath roadways without need for digging a trench across the roadway. These tools include, as general components, a torpedo-shaped body having a tapered nose and an open rear end, an air supply hose which enters the rear of the tool and connects it to an air compressor, a piston or striker disposed for reciprocal movement within the tool, and an air distributing mechanism for causing the striker to move rapidly back and forth. The striker impacts against the front wall (anvil) of the interior of the tool body, causing the tool to move violently forward into the soil. The friction between the outside of the tool body and the surrounding soil tends to hold the tool in place as the striker moves back for another blow, resulting in incremental forward movement through the soil. Exhaust passages are provided in the tail assembly of the tool to allow spent compressed air to escape into the atmosphere.

Most impact boring tools of this type have a valveless air distributing mechanism which utilizes a stepped air inlet. See, for example, Sudnishnikov et al. U.S. Pat. No. 3,410,354, issued Nov. 12, 1968. The step of the air inlet is in sliding, sealing contact with a tubular cavity in the rear of the striker. The striker has radial passages through the tubular wall surrounding this cavity, and an outer bearing surface of enlarged diameter at the rear end of the striker. This bearing surface engages the inner surface of the tool body.

Air fed into the tool enters the cavity in the striker through the air inlet, creating a constant pressure which urges the striker forward. When the striker has moved forward sufficiently far so that the radial passages clear the front end of the step, compressed air enters the space between the striker and the body ahead of the bearing surface at the rear of the striker. Since the cross-sectional area of the front of the striker is greater than the cross-sectional area of its rear cavity, the net force exerted by the compressed air now urges the striker backwards instead of forwards. This generally happens just after the striker has imparted a blow to the anvil at the front of the tool.

As the striker moves rearwardly, the radial holes pass back over the step and isolate the front chamber of the tool from the compressed air supply. The momentum of the striker carries it rearwardly until the radial holes clear the rear end of the step. At this time the pressure in the front chamber is relieved because the air therein rushes out through the radial holes and passes through exhaust passages at the rear of the tool into the atmosphere. The pressure in the rear cavity of the striker, which defines a constant pressure chamber together with the stepped air inlet, then causes the striker to move forwardly again, and the cycle is repeated.

In some prior tools, the air inlet includes a separate air inlet pipe, which is secured to the body by a radial flange having exhaust holes therethrough, and a stepped bushing connected to the air inlet pipe by a flexible hose. See Sudnishnikov et al. U.S. Pat Nos. 3,410,354, issued Nov. 12, 1968 and 4,078,619, issued Mar. 14, 1978.

These tools have been made reversible by providing a threaded connection between the air inlet sleeve and the surrounding structure which holds the air inlet concentric with the tool body. See, for example, Sudnishnikov et al. U.S. Pat No. 3,756,328, issued Nov. 12, 1968. The threaded connection allows the operator to rotate the air supply hose and thereby displace the stepped air inlet rearwardly relative to the striker. Since the stroke of the striker is determined by the position of the step, i.e., the positions at which the radial holes are uncovered, rearward displacement of the stepped air inlet causes the striker to hit against the tail nut at the rear of the tool instead of the front anvil, driving the tool rearwardly out of the hole.

The screw reverse mechanism described in the foregoing U.S. Pat. 3,756,328 has proven inconvenient. To reverse the tool, it is often necessary to rotate the air hose as many as 12–18 times. This can prove difficult when the tool has travelled a great distance because of the length of hose that must be rotated.

The foregoing tool also employs a large, heavy tailpiece which is threadedly secured in the rear end of the tool body. In practice this type of tailpiece has proven very difficult to remove, making the tool hard to disassemble for servicing or replacement of worn parts. The '328 tool also utilizes a large, cylindrical shock absorber through which the exhaust passages are formed. This shock absorber must generally be bonded to the adjoining casing and tailpiece, again rendering the tool difficult to assemble and disassemble.

The tailpiece of the '328 tool and other conventional tools has a rearwardly tapered rear portion with a central circular hole through which the air hose extends. As shown in Bouplon U.S. Pat. No. 4,662,457, issued May 5, 1987, the hose is generally secured to the air inlet by a metal coupling. Exhaust air must pass between the metal coupling and the rim of the tailpiece in order to escape from the tool. During reverse movement, small stones can become jammed in the space between the coupling and the tailpiece, making it impossible to rotate the hose to switch modes.

The tool body of the foregoing known tools is generally made from a solid steel bar which is drilled out to form the tubular tool body. This method of fabricating the tool body is results in a large amount of wasted material, increasing substantially the cost to manufacture such a tool.

Known tools also produce a loud, high-pitched ringing sound during operation. This sound results from the undampened blows of the striker against the body, and poses a potential health hazard to the tool user.

The present invention addresses the foregoing drawbacks of known tools.

SUMMARY OF THE INVENTION

The present invention provides a self-propelled impact boring tool which, according to one aspect of the invention, has a simplified tail assembly so that the tool can be readily assembled and dissambled to allow replacement of worn parts. Such a tail assembly includes a nut and an end cap which can be secured together by a series of conventional bolts which extend into threaded holes in the nut. The nut, which is screwed into the rear end of the tool body, can be clamped in position with the screws with far less torque than would otherwise be required with a conventional, unitary tailpiece.

According to a further aspect of the invention, a striker having a simplified, tubular construction is provided. Such a striker has an annular impact surface and radial ports at both ends of the striker which communicate with frontwardly and rearwardly opening recesses in the striker, respectively. Identical, readily replaceable bearing seals are provided near opposite ends of the striker. The striker may also have an internal cavity in which a vibration dampening material may be disposed.

The invention also provides an improved stepped air inlet valve which is threadedly coupled to the tail nut to provide a reversing function. A flexible tubular hose enters the rear of the tool and preferably extends all the way to the rearwardly opening recess in the striker, in which it is secured to the inside of a tubular bushing which engages the inner surface of the recess to provide the stepped end of the air inlet. An adjuster sleeve having exterior threads couples the hose to the threaded central hole of the tail nut. According to a preferred aspect of the invention, the adjuster sleeve and nut are coupled by a large pitch, double-helix threading, so that the tool can be switched to reverse mode with fewer turns of the hose, and with less likelihood of becoming jammed.

According to a further aspect of the invention, the tool body is formed by swaging a steel tube to form the tapered nose of the tool. This process results in less wasted steel as compared to conventional machining of a solid steel bar to form the body, which is the largest single part of the tool.

BRIEF DESCRIPTION OF THE DRAWING

The invention will hereafter be described with reference to the accompanying drawing, wherein like numerals denote like elements, and.

DETAILED DESCRIPTION OF PREFERRED EMBODIMENTS

Figure 1:
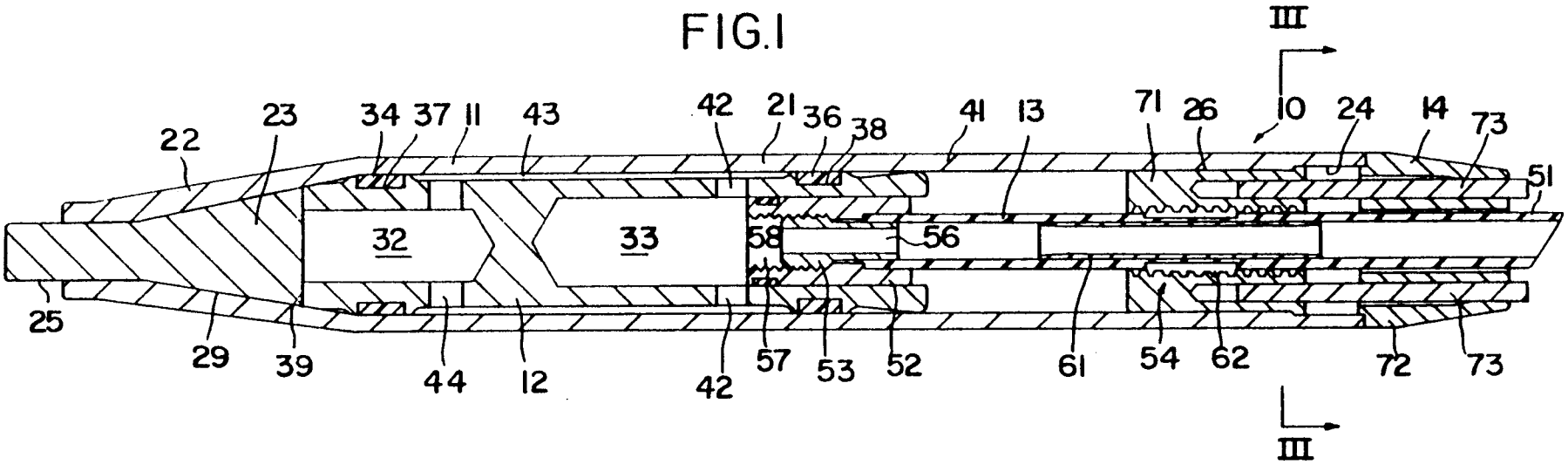
FIG. 1 is a lengthwise sectional view of an impact boring tool according to the invention.

Referring now to FIG. 1, a pneumatic ground piercing tool 10 according to the invention includes, as main components, a tool body 11, a striker 12 for impacting against the interior of body 11 to drive the tool forward, a stepped air inlet conduit 13 which cooperates with striker 12 for supplying compressed air to reciprocate striker 12, and a tail assembly 14 which allows exhaust air to escape from the tool, secures conduit 13 to body 11, and provides a threaded connection to allow reverse operation. Each of these components will now be described in detail.

Tool body 11 comprises a cylindrical hollow housing 21 having a tapered nose 22. Nose 22 can be made by swaging a front end portion of a tubular steel pipe against a frontwardly tapering, generally frustonconical forming anvil. After swaging is completed, the forming anvil is removed, and the swaged housing is reheated. The anvil 23 is then inserted into the housing as shown in FIG. 1. Anvil 23 is nearly identical in shape to the forming anvil, except that it has a cylindrical front end portion 25 which has a slightly greater diameter than the corresponding portion of the forming anvil, and a rear end portion 29 has a slightly smaller diameter than the corresponding portion of the forming anvil. This assures that anvil 23 will remain securely coupled to housing 21 during use of the tool.

The rear end of the pipe is then cut to size, and the interior of housing 21 is then machined to provided a counterbore 24 of slightly enlarged inner diameter. Screw threads 26 are then cut on the interior surface of housing 21 inwardly of but near to counterbore 24 to allow the tail assembly to be secured thereto, as described hereafter. The foregoing method of forming body 11 according to the invention, utilizing generally known swaging techniques, substantially reduces the amount of material (steel) needed to make tool 10.

Striker 12 is disposed for sliding, back-and-forth movement inside of tool body 11 forwardly of conduit 13 and tail assembly 14. Striker 12 comprises a cylindrical rod 31 having frontwardly and rearwardly opening blind holes (recesses) 32, 33 respectively therein. A pair of plastic, front and rear seal bearing rings 34, 36 are disposed in corresponding annular grooves 37, 38 in the outer periphery of rod 31 for supporting striker 12 for movement along the inner surface of body 11. Annular front impact surface 39 impacts against anvil 23 when the tool is in forward mode, as shown in FIG. 1, and an annular rear impact surface 41 impacts against tail assembly 14 when the tool is in rearward mode.

A plurality of rear radial holes 42 allow communication between recess 33 and the annular space 43 between striker 12 and body 11 bounded by seal rings 34, 36. A second set of front radial holes 44 allow communication between space 43 and front recess 32. Annular space 43, holes 44, front recess 32 and the interior space of body 11 ahead of striker 12 (after striker 12 has moved backwards from the position shown in FIG. 1) together comprise the front, variable pressure chamber of the tool. Anvil 23 may optionally have a narrow central air passage (not shown) allowing limited communication between the front pressure chamber and the front end of the tool for injecting air into the hole being formed to loosen the soil ahead of the tool.

Referring now to FIGS. 1 through 5, stepped air inlet conduit 13 includes a flexible hose 51, a tubular bushing 52 fitted with an inner locking nut 53, and an adjuster screw mechanism 54. Hose 51, which may be made of rubberized fabric, is secured by a coupling (not shown) to a further length of hose which ultimately connects tool 10 with the air compressor. The inner end of hose 51 is clamped to the inner wall of bushing 52 by nut 53, which is threadedly coupled with bushing 52. Nut 53 has a bore 56 which allows compressed air to pass from hose 51 through nut 53 and bushing 52 into cavity 33. In the alternative, hose 51 may be adhesively bonded directly to the interior of bushing 52, and nut 53 may be omitted.

The cylindrical outer surface of bushing 52 is inserted into cavity 33 in slidable, sealing engagement with the wall thereof. Cavity 33 and the adjoining interior space of stepped conduit 13 together comprise a rear, constant pressure chamber which communicates intermittently with the front, variable pressure chamber by means of holes 42. Bushing 52 may, if needed, have a plastic bearing ring 57 disposed in an annular peripheral groove 58 to reduce air leakage between bushing 52 and the wall of cavity 33.

Figure 6:
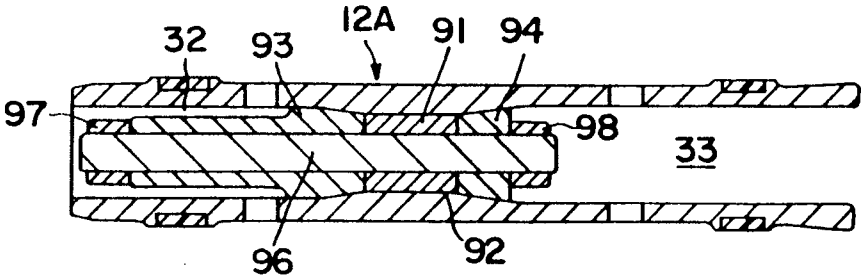
FIG. 6 is a lengthwise sectional view of an alternative embodiment of a striker according to the invention.
Figure 5:
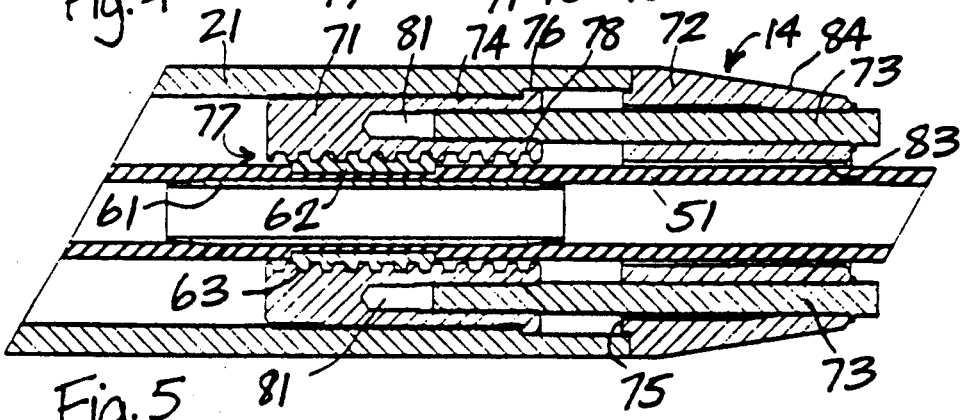
FIG. 5 is a partial, enlarged sectional view taken along the line V—V in FIG. 2.

Adjuster screw mechanism 54 includes a tubular inner sleeve 61 disposed inside of hose 51 and a coaxial outer sleeve 62 which has outer peripheral threads 63 for securing the stepped conduit 13 to tail assembly 14, as described below. Hose 51 is clamped under compression between sleeves 61, 62 as shown in FIGS. 5 and 6. Outer sleeve 62 may, in addition, be secured to the outside of hose 51 by an adhesive. If the adhesive bond is sufficiently strong, inner sleeve 61 may be omitted. The foregoing structure renders mechanism 54 light in weight, which reduces the effect of axial shocks transmitted thereto through sleeve 62 and helps eliminate the need for a shock dampening coupling. For this purpose, bushing 52 is preferably made of a light-weight material such as aluminum, and outer sleeve 62 is made as short as possible, e.g. only about half or less the length of the threaded hole in which it is mounted. Sleeve 62 preferably is only long enough to provide enough screw thread turns to effect the operating mode change, i.e., about 6 or less.

Tail assembly 14 includes a tail nut (rear anvil) 71 and a end cap (cone) 72 secured together by bolts 73. Tail nut 71 has outer peripheral threads 74 in engagement with threads 26 on the interior of housing 21, and an end flange 76 for retaining nut 71 in counterbore 24. Nut 71 further has a central hole 77 having screw threads 78 in engagement with threads 63 of sleeve 62. Threads 78 have blind front ends so that movement of sleeve 62 is limited to the forwardmost position shown in FIG. 1. Threads 78 open rearwardly so that air inlet conduit 13 can be unscrewed and removed from nut 71. An inner end boss 75 of cap 72 limits rearward movement of sleeve 62 to a rearwardmost position when cap 72 is secured to nut 71 so that sleeve 62 cannot become disengaged from nut 71 during operation.

According to a preferred embodiment of the invention, threads 63, 78 are formed in a double helix having a helix angle in the range of about 7 to 10 degrees, particularly 8 to 9.5 degrees. The double helix threading provides the connection with additional strength, while allowing a large axial displacement for each turn of hose 51. The large helix angle reduces the tendency of the threaded coupling to become locked, but is not so large that the adjuster screw mechanism will unscrew too easily. Threads 63, 78 preferably have a height and width of at least about 0.1 inch, especially 0.1 to 0.25 inch, to provide a stronger coupling better able to withstand shocks transmitted through nut 71 from the tool body.

Figure 3:
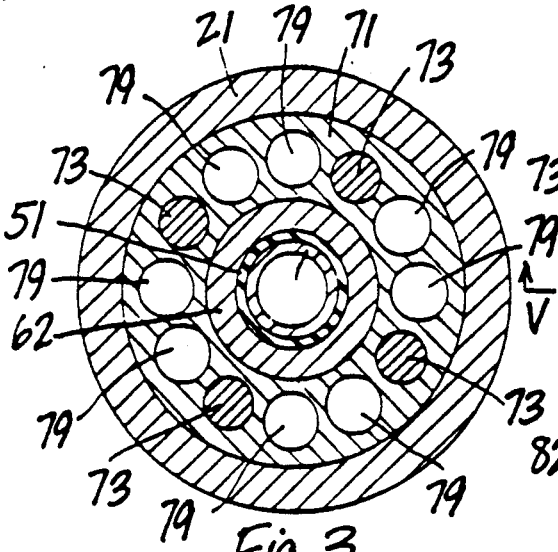
FIG. 3 is a cross-sectional view taken along the line III—III in FIG. 1.
Figure 2:
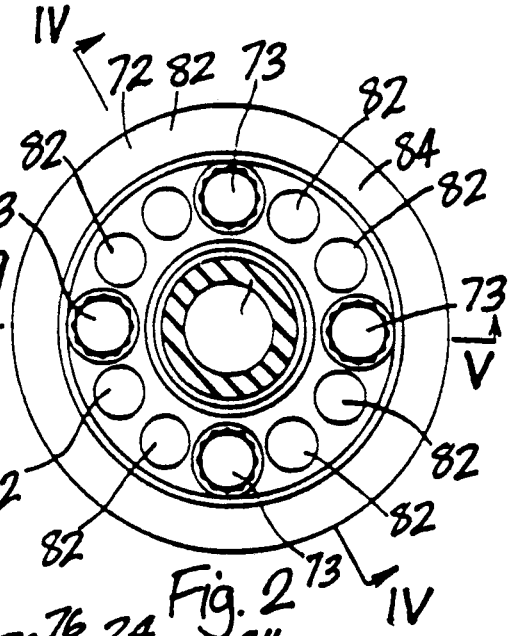
FIG. 2 is a rear view, showing the air hose in section, of the tool shown in FIG. 1.
Figure 4:
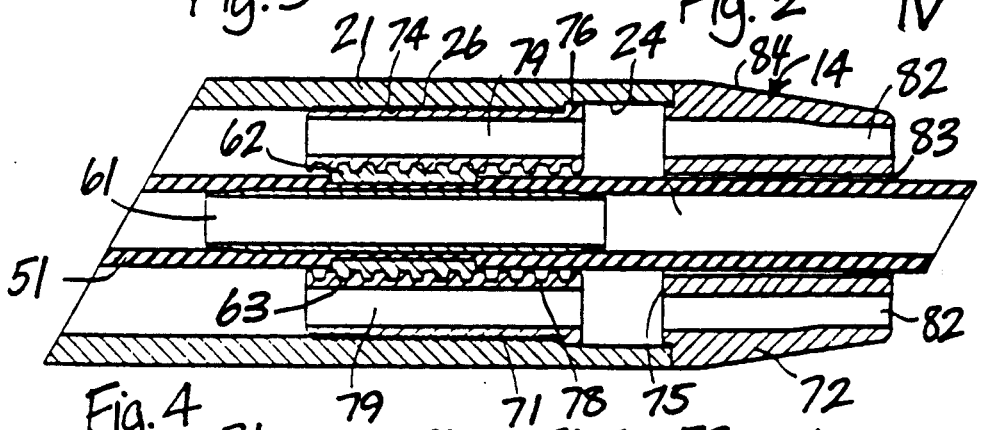
FIG. 4 is a partial, enlarged sectional view taken along the line IV—IV in FIG. 2.

Tail nut 71 is provided with a plurality of exhaust passages 79 and blind threaded holes 81 for receiving bolts 73. Passages 79 and holes 81 are parallel to each other and to central hole 77, and are most advantageously arranged in a circular formation as shown in FIGS. 2 and 3. Since the power of the tool increases as the cross-sectional area of the exhaust passages increases, this construction allows tool power to be maximized without weakening nut 71 excessively. Prior tools employing large resilient shock absorbers having exhaust passages formed therein are more limited in the area available for forming exhaust passages. The present invention, by eliminating the need for a large resilient shock absorber to protect the screw reverse connection from shocks, provides a more powerful tool.

Tail cap 72 has a series of exhaust openings 82 preferably of the same dimensions as exhaust passages 79. Openings 82 prevent stones from becoming jammed between the tail assembly and the hose coupling, referred to above, which is behind the tool instead of inside the tailpiece as in prior tools. Cap 72 also has a large central hole 83 through which hose 51 passes, and a rearwardly tapering outer surface 84 to facilitate reverse movement.

The foregoing tail assembly further enhances the serviceability of the tool. The large, unitary tail pieces used in prior tools must be tightly secured in the rear end of the tool body in order to ensure that the tail piece will remain in place during use. The torque required to unscrew the tailpiece is great, making the tool very difficult to take apart. By contrast, bolts 73 can provide the needed clamp load to lock the tail assembly in position, but require far less torque to unscrew. Once bolts 73 have been loosened, nut 71, cap 72 and bolts 73 can be easily turned in unison to remove the tail assembly.

Referring now to FIG. 6, an alternative embodiment of a striker 12A according to the invention is filled with a vibration dampening material, such as steel shot 91. Shot 91 is confined in a annular chamber 92 between chambers 32, 33 by a pair of front and rear plugs 93, 94 through which a double-ended bolt 96 is inserted. A pair of nuts 97, 98 mounted on opposite threaded ends of bolt 96 hold plugs 93, 94 in position. Shot 91 dampens vibrations which arise as striker 12A impacts against the associated anvil, greatly reducing the amount of noise made by the tool during operation.

Figure 7:
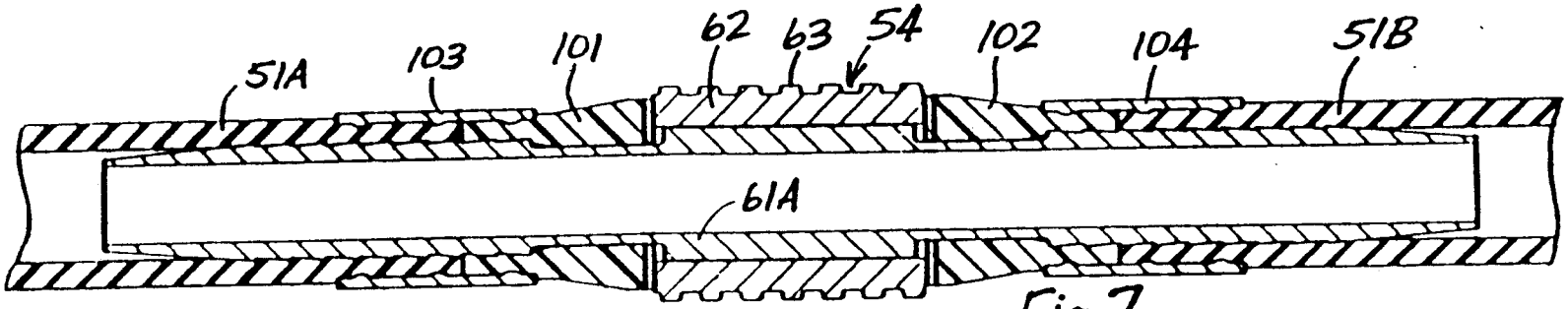
FIG. 7, 8 and 9 are each partial, lengthwise sectional views of three alternative embodiments of air inlet assemblies according to the invention.
Figure 8:
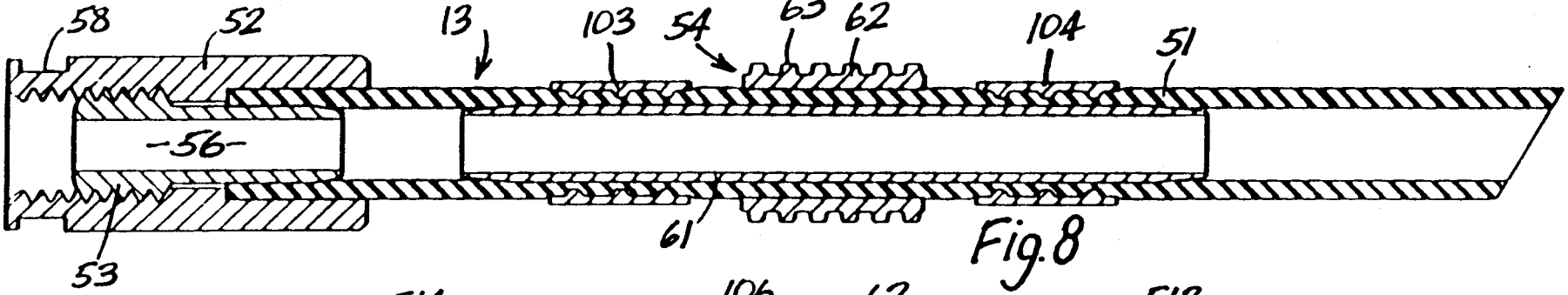
Figure 9:
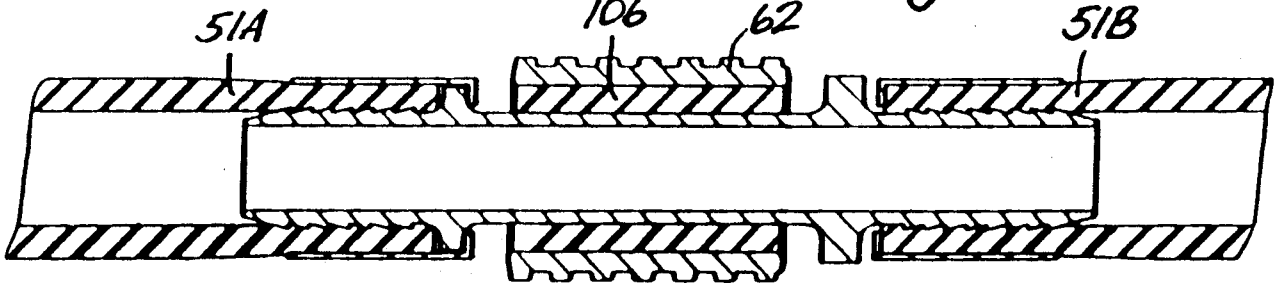

FIGS. 7, 8 and 9 illustrate alternative constructions for the stepped conduit 13. In FIG. 7, hose 51 is broken into sections 51A and 51B. Outer sleeve 62 is in direct contact with an enlarged diameter central portion of a modified inner sleeve 61A. A pair of front and rear plastic couplings 101, 102 isolate sleeve 62 from hose sections 51A, 51B. Couplings 101, 102 may be made of high density polyurethane. Sleeve 62 is slightly separated from couplings 101, 102, and may slide along the outer surface of sleeve 61A into either of couplings 101, 102, which act as shock absorbers. A pair of clamps 103, 104 secure hose sections 51A, 51B to inner sleeve 61A and couplings 101, 102, respectively. In FIG. 8, clamps 103, 104 are used to further secure the screw adjuster mechanism, and couplings 101, 102 are omitted. In FIG. 9, an elastomeric shear coupling 106 is interposed between inner and outer sleeves 61A, 62 to provide additional shock dampening effects. Shear coupling 106 is adhesively bonded to sleeves 61A, 62.

It will be understood that the foregoing description is of preferred exemplary embodiments of this invention, and that the invention is not limited to the specific forms shown. For example, the described mechanism for providing a flexible hose with a threaded outer sleeve could be used in other applications wherein it is desired to threadedly secure a hose to a fixture. These and other modifications may be made in the design and arrangement of the elements without departing from the scope of the invention as expressed in the appended claims.

What is claimed is:

1. A reversible, pneumatic ground-piercing tool, comprising:

an elongated hollow body having a front nose and a rear opening;

a striker disposed for reciprocation within said body, said striker having a rearwardly opening recess and a rear radial passage through a wall enclosing said recess;

a stepped air inlet conduit which cooperates with said striker to reciprocate said striker within said body and impart blows to a front end wall thereof to drive said tool forwardly, including a bushing in sliding, sealing engagement with said recess in said striker, a flexible hose which extends lengthwise through said tool for conducting compressed air to said striker, means for securing said hose to said bushing, a threaded sleeve rearwardly spaced from said bushing, said sleeve having a threaded outer surface, a tubular inner sleeve disposed coaxially inside of said threaded sleeve, and an elastomeric shear coupling securing the inner surface of said threaded sleeve to the outer surface of said inner sleeve; and a tail assembly including a lengthwise threaded hole extending through said tail assembly threadedly coupled to said outer surface of said threaded sleeve to permit axial displacement of said air inlet conduit to a rear position for effecting reverse movement of said tool and to a front position for effecting forward movement of said tool, said tail assembly further having exhaust passages which communicate intermittently with said passage in said striker as said passage in said striker passes rearwardly over a rear end of said bushing for exhaust of spent compressed air.

2. The tool of claim 1, wherein said hose is secured to an interior surface of said bushing, and wherein said hose runs continuously from said rear opening of said body to said bushing.

3. The tool of claim 1, wherein the threads of said threaded lengthwise hole in said tail assembly have a blind front end which prevents disengagement of said threaded sleeve from said lengthwise threaded hole by forward movement of said threaded sleeve relative to said lengthwise threaded hole.

4. The tool of claim 1, wherein said striker is generally cylindrical and further has:

a rear annular bearing surface for engaging the interior of said body located behind said rear radial passage;

a frontwardly opening recess;

an annular impact surface surrounding said front recess for delivering impacts to said body;

a front radial passage through a tubular wall enclosing said front recess; and a front annular bearing surface for engaging the interior of said body located in front of said front radial passage.

5. The tool of claim 2, wherein said tubular inner sleeve is disposed completely within said hose axially with said threaded sleeve and clamps said hose against the inner surface of said threaded sleeve.

6. The tool of claim 1, wherein said hose comprises a first section which spans said bushing and said threaded sleeve, and a second section which is connected to the rear of said threaded sleeve, and means for securing said first and second hose sections to said inner sleeve.

7. The tool of claim 1, wherein said threaded sleeve has a length of half or less the length of said lengthwise threaded hole.

8. A reversible, pneumatic ground-piercing tool, comprising:

an elongated hollow body having a front nose and a rear opening;

a striker disposed for reciprocation within said body, said striker having a rearwardly opening recess and a rear radial passage through a wall enclosing said recess;

a stepped air inlet conduit which cooperates with said striker to reciprocate said striker within said body and impart blows to a front end wall thereof to drive said tool forwardly, including a bushing in sliding, sealing engagement with said recess in said striker, a flexible hose which extends lengthwise through said tool for conducting compressed air too said striker, means for securing said hose to said bushing, a threaded sleeve rearwardly spaced from said bushing, said sleeve having a threaded outer surface, and means for resiliently mounting said threaded sleeve on said hose; and a tail assembly including a lengthwise threaded hole extending through said tail assembly threadedly coupled to said outer surface of said threaded sleeve to permit axial displacement of said air inlet conduit to a rear position for effecting reverse movement of said tool and to a front position for effecting forward movement of said tool, said tail assembly further having exhaust passages which communicate intermittently with said passage in said striker as said passage in said striker passes rearwardly over a rear end of said bushing for exhaust of spent compressed air;

wherein the outer surface of said threaded sleeve has 6 or fewer screw thread turns thereon, and the threads of said lengthwise threaded hole and said outer surface of said threaded sleeve are formed in a double-helix having a helix angle in the range of about 7 to 10 degrees.

9. The tool of claim 8, wherein said double-helix threads have a height and width in the range of 0.1 to 0.25 inch.

10. A reversible, pneumatic ground-piercing tool, comprising:

an elongated hollow body having a front nose and a rear opening;

a striker disposed for reciprocation with said body, said striker having a rearwardly opening recess and a rear radial passage through a wall enclosing said recess;

a stepped air inlet conduit which cooperates with said striker to reciprocate said striker within said body and impart blows to a front end wall thereof to drive said tool forwardly, including a bushing in sliding, sealing engagement with said recess in said striker, a flexible hose which extends lengthwise through said tool for conducting compressed air to said striker, means for securing said hose to said bushing, a threaded sleeve rearwardly spaced from said bushing, said sleeve having a threaded outer surface, and means for resiliently mounting said threaded sleeve on said hose; and a tail assembly including a lengthwise threaded hole extending through said tail assembly threadedly coupled to said outer surface of said threaded sleeve to permit axial displacement of said air inlet conduit to a rear position for effecting reverse movement of said tool and to a front position for effecting forward movement of said tool, said tail assembly further having exhaust passages which communicate intermittently with said passage in said striker as said passage in said striker passes rearwardly over a rear end off said bushing for exhaust of spent compressed air;

wherein said tail assembly further comprises a generally cylindrical, unitary metal tail nut, said nut having said lengthwise threaded hole to which said threaded sleeve is coupled formed centrally therein, and a plurality of said exhaust passages extending therethrough, and an outer surface of said tail nut has threads secured in mating threads formed on the inner surface of said tool body near said rear opening.

11. The tool of claim 10, wherein said central lengthwise hole of aid tail nut is coaxial with the lengthwise axis of said body, and said exhaust passages are arranged parallel to said central lengthwise hole in a generally circular formation surrounding said hole.

12. The tool of claim 11, wherein said tail nut further has a rearwardly opening threaded hole therein parallel to said central lengthwise hole at a position offset from said central lengthwise threaded hole, and said tail assembly further comprises:

an end cap disposed to fit over said rear opening of said body, said end cap having a first opening therein in alignment with said threaded rearwardly opening hole in said tail nut, a second opening therein for allowing exhaust air from said exhaust passages to escape into the atmosphere, and a central hole through which an external compressed air supply hose may pass; and a bolt which extends through said first opening and is threadedly secured inn said rearwardly opening threaded hole in said tail nut so that said tail nut is clamp load to said tool body.

13. The tool of claim 12, wherein said cap has an inner face covering said rear end opening of said tool body such that, when said cap is secured to said body, said inner face blocks complete disengagement of said threaded sleeve from said lengthwise threaded hole by rearward movement of said threaded sleeve relative to said lengthwise threaded hole.

14. A reversible, pneumatic ground-piercing tool, comprising:

an elongated hollow body having a front nose and a rear opening;

a striker disposed for reciprocation within said body, said striker having a rearwardly opening recess and a rear radial passage through a wall enclosing said recess;

a stepped air inlet conduit which cooperates with said striker to reciprocate said striker within said body and impart blows to a front end wall thereof to drive said tool forwardly, including a bushing inn sliding, sealing engagement with said recess in said striker, a flexible hose which extends lengthwise through said tool for conducting compressed air to said striker, means for securing said hose to said bushing, a threaded sleeve rearwardly spaced from said bushing, said sleeve having a threaded outer surface, and means for resiliently mounting said threaded sleeve on said hose; and a tail assembly including a lengthwise threaded hole extending through said tail assembly threadedly coupled to said outer surface of said threaded sleeve to permit axial displacement of said air inlet conduit to a rear position for effecting reverse movement of said tool and to a front position for effecting forward movement of said tool, said tail assembly further having exhaust passages which communicate intermittently with said passage in said striker as said passage in said striker passes rearwardly over a rear end of said bushing for exhaust of spent compressed air;

wherein aid hose comprises a first section which spans said bushing and said threaded sleeve, and a second section which is connected to the rear of said threaded sleeve, said mounting means comprises a tubular inner sleeve disposed in sliding contact with the inner periphery of said threaded sleeve, and a pair of resilient, shock-absorbing couplings mounted on said inner sleeve at opposite ends of said threaded sleeve to limit axial movement of said threaded sleeve relative to said inner sleeve, and means for securing said first and second hose sections to said inner sleeve.

15. A pneumatic ground-piercing tool, comprising:

an elongated hollow body having a front nose and a rear opening;

a striker disposed for reciprocation within said body;

a mechanism for reciprocating said striker, including an air inlet conduit extending forwardly from said rear opening for supplying compressed air to said striker, whereby said striker imparts blows to a front end wall of said body to drive said tool forwardly; and a tail assembly for securing the air inlet conduit to the tool body, including a tail nut having exterior threads coupled to mating threads formed on the inner surface of said body near said rear opening to secure said tail nut to said body, said tail nut having a hole extending therethrough in which said air inlet conduit is mounted, and exhaust passages for exhaust of spent compressed air; and means for applying an axial clamp load to said tail nut.

16. The tool of claim 15, wherein said nut has a plurality of threaded, rearwardly opening holes therein, and said means for applying an axial clamp load comprises:

an end cap disposed to fit over said rear opening of said body, said end cap having first openings therein in alignment with said threaded holes in said tail nut, a second opening therein for allowing exhaust air from said exhaust passages to escape into the atmosphere, and a central hole through which an air supply hose may pass; and a plurality of bolts which extend through said first openings and are threadedly secured inn said threaded holes in said tail nut so that said end cap is securely clamped to said tail nut.

17. The tool of claim 16, wherein said central lengthwise hole of said tail nut is coaxial with the lengthwise axis of said body, said exhaust passages are arranged parallel to said central lengthwise hole in a generally circular formation surrounding said hole, and said rearwardly opening threaded holes in said nut are also parallel to said central lengthwise hole and are interposed between exhaust passages in said circular formation.

18. The tool of claim 15, further comprising means for reversing the direction of travel of said tool.

19. The tool of claim 18, wherein said striker has a rearwardly opening recess and a radial passage through a wall enclosing said recess, said mechanism includes a stepped bushing in sliding, sealing engagement with said recess in said striker, said exhaust passages communicate intermittently with said radial passage in said striker as said radial passage in said striker passes rearwardly over a rear end of said bushing for exhaust of spent compressed air, and said reversing means comprises interior threads on the central lengthwise hole of said tail nut and exterior threads on said air inlet conduit.

20. A pneumatic ground-piercing tool including an elongated hollow body having a forwardly tapering nose and a rear opening, a striker disposed for reciprocation within said body, said striker having a rearwardly opening recess, a rear radial passage through a wall enclosing said recess, and a rear radial passage through a wall enclosing said recess, and a rear annular bearing surface located behind said rear radial passage for engage the interior of said body, a stepped air inlet conduit which cooperates with said striker to reciprocate said striker within aid body and impart blows to a front end wall thereof to drive said tool forwardly, including a bushing in sliding, sealing engagement with said rear recess in said striker, and a tail assembly for securing the air inlet conduit to the tool body, improved in that:

said striker is cylindrical and has a frontwardly opening recess, an annular front impact surface surrounding said front recess, a front radial passage through a tubular wall enclosing said front recess, and a front annular bearing surface located in front of said front radial passage for engaging the interior of said body.

21. The tool of claim 20, wherein said striker has an internal chamber filled with a vibration dampening material, which chamber is located between said frontwardly and rearwardly opening recesses.

22. The tool of claim 20, wherein said front and rear bearing surfaces comprise front and rear annular plastic bearing rings disposed in corresponding front and rear annular grooves in the outer surface of said striker.

23. A reversible, pneumatic ground-piercing tool, comprising:

an elongated hollow body having a forwardly tapering nose and a rear opening;

a striker disposed for reciprocation within said body, said striker having a rearwardly opening recess and a radial passage through a wall enclosing said recess;

a stepped air inlet conduit which cooperates with said striker to reciprocate said striker within said body and impart blows to a front end wall thereof to drive said tool forwardly, including a bushing in sliding, sealing engagement with said recess in said striker, a flexible hose secured to said bushing, which hose extends lengthwise through said tool for conducting compressed air to said striker, and a threaded sleeve secured to the outside of said hose rearwardly spaced from said bushing; and a tail assembly threadedly coupled to said threaded sleeve to permit axial displacement of said air inlet conduit to a rear position for effecting reverse movement of aid tool and to a front position for effecting forward movement of said tool, said tail assembly further having exhaust passages which communicate intermittently with said radial passage in said striker as said radial passage in said striker passes rearwardly over a rear end of said bushing for exhaust of spent compressed air, wherein said tail assembly comprises:

a tail nut secured to said body and having a central threaded hole to which said threaded sleeve is coupled, a plurality of said exhaust passages extending therethrough, and a plurality of threaded, rearwardly opening holes therein;

an end cap disposed to fit over said rear opening of said body, said end cap having first openings therein in alignment with said threaded holes in said tail nut, second openings therein for allowing exhaust air from said exhaust passages to escape into the atmosphere, and a central hole through which said hose passes; and a plurality of bolts which extend through said first openings and are threadedly secured in said threaded holes in said tail nut so that said end cap is securely clamped to said tool body and an axial clamp load is applied to said tail nut.

* * * * *